US009705263B2

(12) United States Patent
Huang et al.

(10) Patent No.: US 9,705,263 B2
(45) Date of Patent: Jul. 11, 2017

(54) PLUG CONNECTOR ASSEMBLY WITH LIGHT PIPE AND PLURAL LEDS

(71) Applicant: FOXCONN INTERCONNECT TECHNOLOGY LIMITED, Grand Cayman (KY)

(72) Inventors: Shuai-Hui Huang, Kunshan (CN); Ru-Yang Guo, Kunshan (CN); Qing-Man Zhu, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/011,669

(22) Filed: Feb. 1, 2016

(65) Prior Publication Data

US 2016/0240984 A1 Aug. 18, 2016

(30) Foreign Application Priority Data

Feb. 13, 2015 (CN) ..... 2015 1 0077501

(51) Int. Cl.

| | |
|---|---|
| ***H01R 13/717*** | (2006.01) |
| *H01R 24/28* | (2011.01) |
| *H01R 13/629* | (2006.01) |
| *H01R 13/66* | (2006.01) |
| *H01R 107/00* | (2006.01) |

(52) U.S. Cl.

CPC ..... *H01R 13/7175* (2013.01); *H01R 13/7172* (2013.01); *H01R 13/62905* (2013.01); *H01R 13/6658* (2013.01); *H01R 24/28* (2013.01); *H01R 2107/00* (2013.01)

(58) Field of Classification Search

USPC ..... 439/620.02, 490, 188, 491, 488, 76.1

See application file for complete search history.

(56) References Cited

U.S. PATENT DOCUMENTS

| | | | | |
|---|---|---|---|---|
| 6,165,006 | A * | 12/2000 | Yeh | H01R 13/6641 439/490 |
| 6,336,825 | B1 * | 1/2002 | Seefried | G02B 6/4204 439/488 |
| 6,361,357 | B1 * | 3/2002 | Stillwell | H01R 13/6691 362/23.01 |

(Continued)

FOREIGN PATENT DOCUMENTS

| | | |
|---|---|---|
| CN | 103124031 | 8/2015 |
| CN | 102761035 | 10/2015 |

*Primary Examiner* — Alexander Gilman

(74) *Attorney, Agent, or Firm* — Wei Te Chung; Ming Chieh Chang

(57) ABSTRACT

A plug connector assembly including a cable connected to a plug connector, the plug connector including an insulative cover having a light region, a printed circuit board (PCB) received in the insulative cover and having a first surface and an opposite second surface, a mating member mounted on the PCB and extending through the insulative cover, a pair of light-emitting diode (LED) lamps, and a light guide disposed between the two LED lamps, wherein the mating member is mounted on the first surface of the PCB and the two LED lamps are mounted on the second surface of the PCB and wherein the light guide has a top face exposed to the light region of the insulative cover.

10 Claims, 6 Drawing Sheets

(56) References Cited

U.S. PATENT DOCUMENTS 6,733,333 B1 * 5/2004 Chen ..... H01R 13/6658 439/552
6,752,649 B2 * 6/2004 Arkin ..... H01R 31/065 439/491
6,921,284 B2 * 7/2005 Sirichai ..... H01R 13/6641 439/490
7,306,479 B1 * 12/2007 Wu ..... H01R 9/034 439/497
7,393,237 B2 * 7/2008 Kuo ..... H01R 13/6691 362/249.01
7,429,188 B2 * 9/2008 Wu ..... H01R 13/7172 439/490
7,628,619 B2 * 12/2009 Chuang ..... H01R 13/6658 439/620.08
7,661,983 B2 * 2/2010 Yang ..... H01R 4/02 439/490
7,744,231 B2 6/2010 Hutchinson et al.
7,753,689 B1 * 7/2010 Wu ..... H01R 13/648 439/490
7,914,320 B2 * 3/2011 Ko ..... H01R 13/502 439/490
7,963,773 B2 * 6/2011 Palli ..... H01R 13/6205 439/38
7,976,336 B2 * 7/2011 Yang ..... H01R 13/6658 439/490
8,124,496 B2 * 2/2012 Su ..... H01R 13/7175 438/449
8,303,333 B2 * 11/2012 Lee ..... H01R 13/7175 439/488
8,333,608 B2 * 12/2012 Ko ..... H01R 13/641 439/490
8,535,088 B2 9/2013 Gao et al.
8,641,445 B2 * 2/2014 Su ..... H01R 13/6658 439/490
9,017,092 B1 * 4/2015 McCracken ..... H01R 13/62 439/374
9,065,205 B2 * 6/2015 Gao ..... H01R 13/5808
9,160,118 B2 * 10/2015 Tuchrelo ..... H01R 13/665
9,196,999 B2 * 11/2015 Shifris ..... H01R 13/465
9,257,800 B2 * 2/2016 Huang ..... H01R 12/61
9,450,350 B2 * 9/2016 Chen ..... H01R 13/717
9,461,417 B2 * 10/2016 Zhang ..... H01R 13/7175
9,480,169 B2 * 10/2016 Huang ..... H01R 13/504
2010/0309657 A1 * 12/2010 Purdy ..... F21L 4/005 362/200
2011/0092081 A1 * 4/2011 Gao ..... H01R 9/03 439/40
2013/0308304 A1 * 11/2013 Tuchrelo ..... H01R 13/7175 362/157
2015/0214677 A1 * 7/2015 Huang ..... H01R 13/7175 439/39

* cited by examiner

PLUG CONNECTOR ASSEMBLY WITH LIGHT PIPE AND PLURAL LEDS

BACKGROUND OF THE INVENTION

1. Field of the Invention

The present invention relates to a plug connector assembly, and more particularly to arrangement of light pipe and associated light-emitting diodes of the plug connector assembly.

2. Description of Related Arts

U.S. Pat. No. 8,535,088, issued on Sep. 17, 2013, discloses a reversible cable plug (connector) including two internal printed circuit boards (PCBs) for two mating orientations. Each PCB carries a light-emitting diode (LED), a light guide or pipe, and a light insulator. Plug housing has an LED opening or exit, e.g., an actual hole or a number of small perforations. Light from LED may be guided by an LED housing towards light pipe which in turn may guide the light through the opening or exit. The light insulator can prevent stray light inside plug connector housing from being emitted through the exit.

SUMMARY OF THE INVENTION

A plug connector assembly comprises: a plug connector including an insulative cover having a light region, a printed circuit board (PCB) received in the insulative cover and having a first surface and an opposite second surface, a mating member mounted on the PCB and extending through the insulative cover, a pair of light-emitting diode (LED) lamps, and a light guide disposed between the two LED lamps; and a cable connected to the PCB, wherein the mating member is mounted on the first surface of the PCB and the two LED lamps are mounted on the second surface of the PCB, and wherein the light guide has a top face exposed to the light region of the insulative cover.

DETAILED DESCRIPTION OF THE PREFERRED EMBODIMENT

Figure 1:
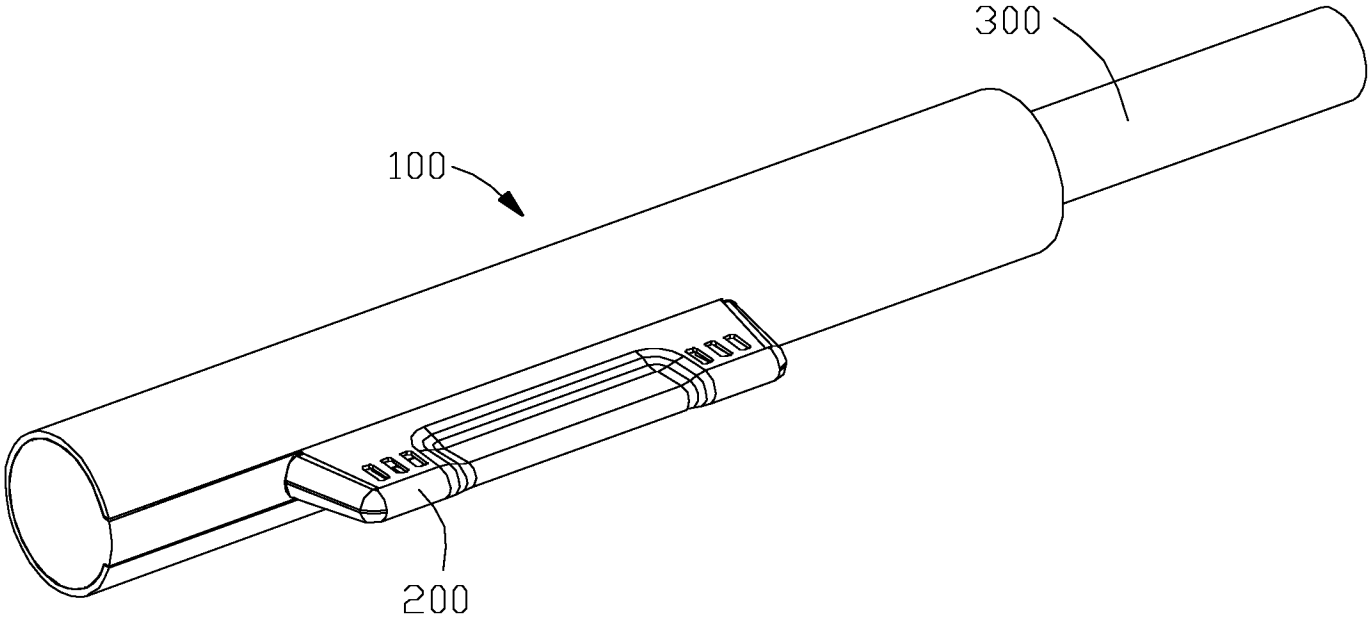
FIG. 1 is a perspective view of a plug connector assembly in accordance with the present invention.
Figure 2:
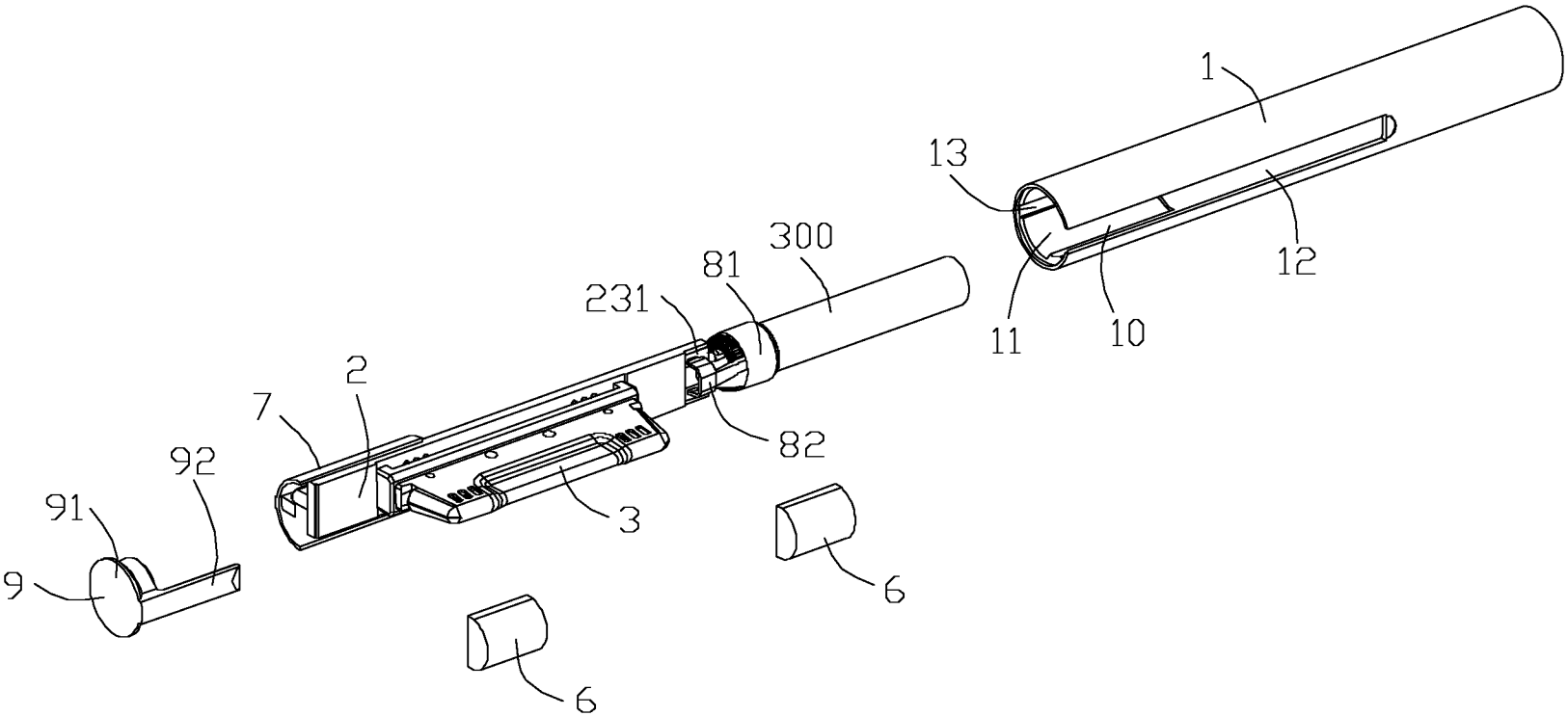
FIG. 2 is a partly exploded view of the plug connector assembly as shown in FIG. 1.
Figure 3:
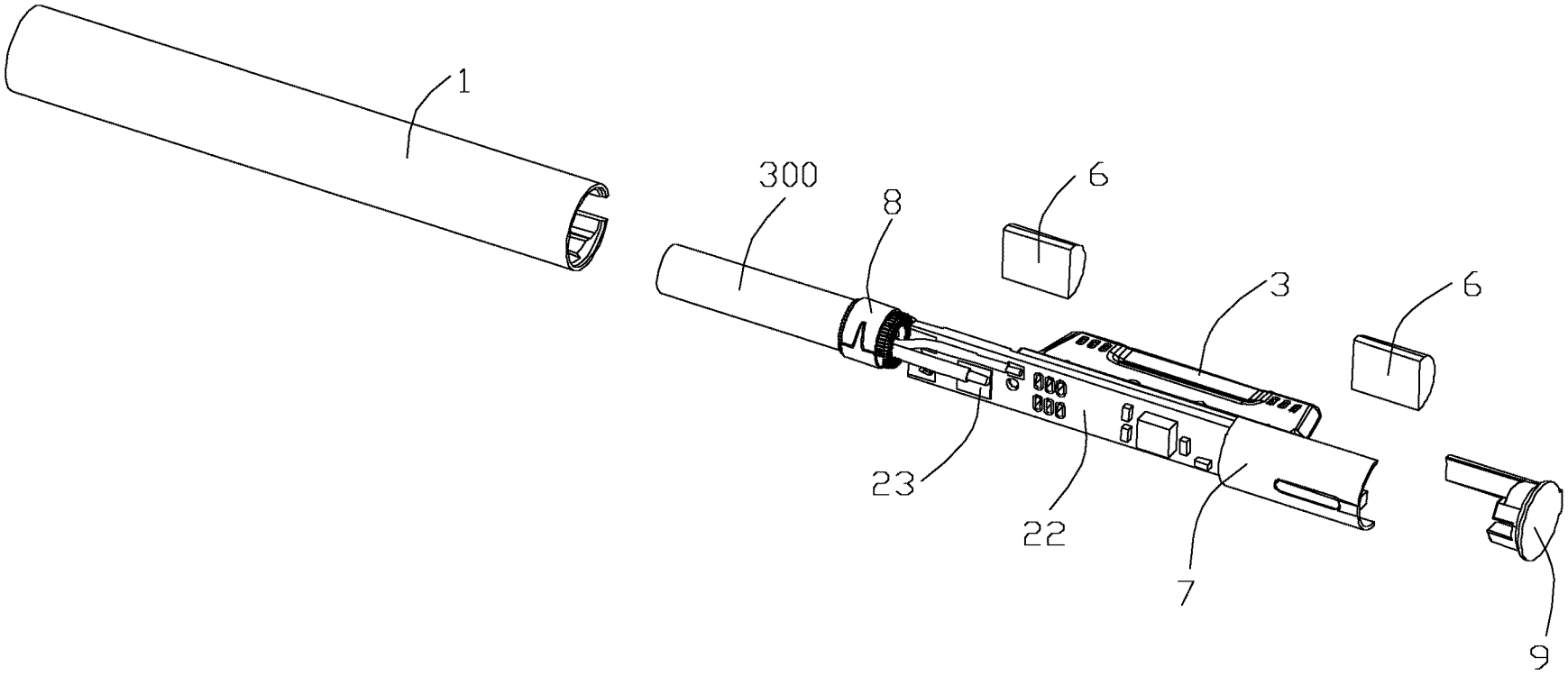
FIG. 3 is a view similar to FIG. 2 but from a different perspective.
Figure 4:
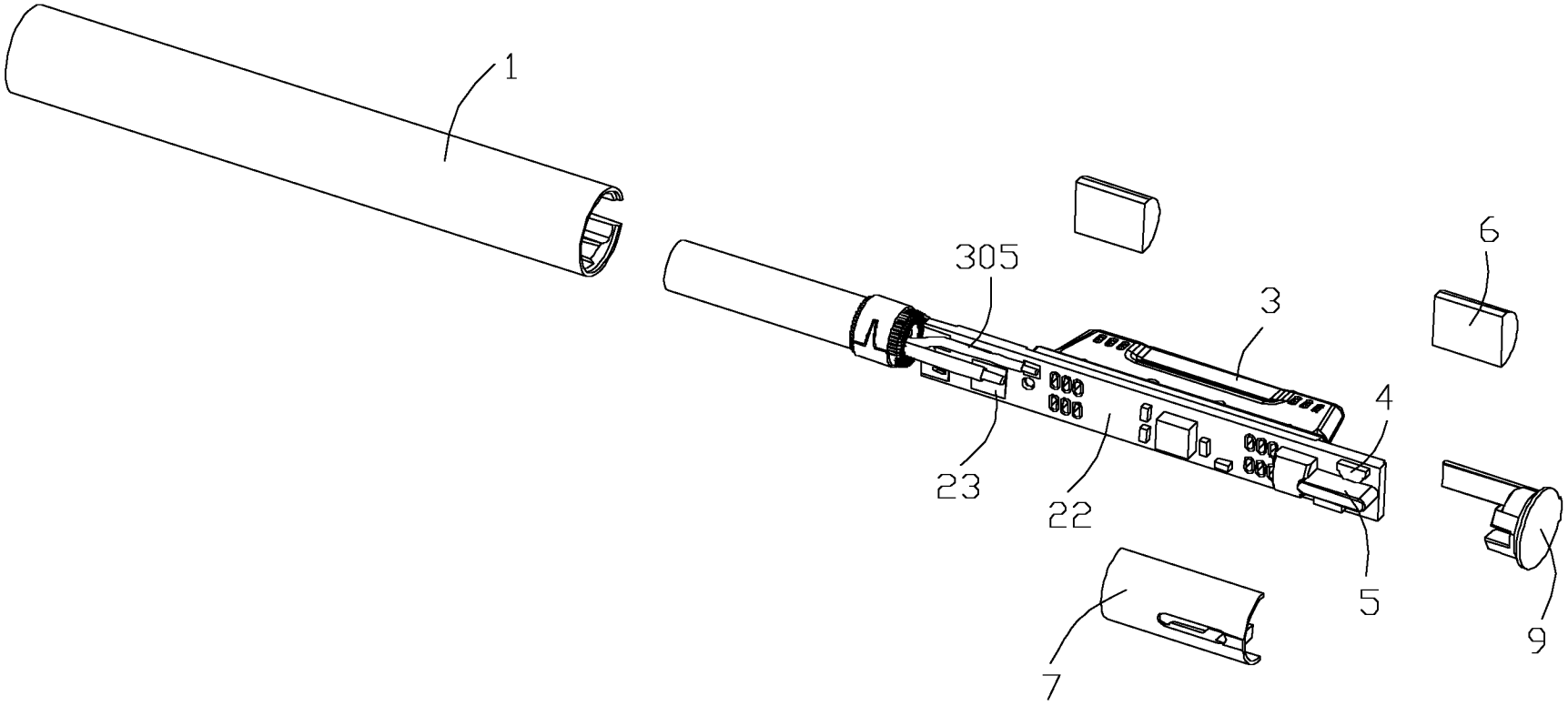
FIG. 4 is a further exploded view of FIG. 3.

Referring to FIGS. 1-6, a plug connector assembly 100 comprises a plug connector 200 and a cable 300 connected to the plug connector 200. The plug connector 200 comprises an insulative cover 1 defining a receiving space 10, a printed circuit board (PCB) 2 received in the insulative cover 1, a mating member 3 mounted on one side of the PCB 2 and extending through the insulative cover 1, a pair of LED lamps 4 mounted on the other side of the PCB 2, a light guide 5, a magnetic member 6 mounted on the PCB 2, a light insulator 7 covering the LED lamps 4 and the light guide 5, a collar 8 for clamping the cable 300, and a front stopple 9 to close an end of the insulative cover 1. The plug connector assembly 100 is of a reversible type so that it can be plugged to a mating receptacle in either of two orientations.

The cable 300 includes a plurality of wires 301, a shielding layer 302, and a jacket 303. The wires comprise a power source line 304 and a control signal line 305.

The insulative cover 1 is cylindrical and comprises a front port 11 and an opposite rear port through which the cable 300 extends. A channel 12 extends along a direction from the front port 31 towards the rear port of the insulative cover 1. The channel 12 connects with the receiving space 10 for the mating member 3 to extend out of the insulative cover 1 to mate with a mating connector.

The PCB 2 has a first surface 21 where the mating member 3 is mounted and an opposite second surface 22 where the LED lamps 4 and the light guide 5 are mounted. The LED lamps 4 and the light guide 5 are distanced further away from the cable 300 than the mating member 3 is. Provided on the PCB 2 are several conductive pads 23 including ground pad 231, power pad 232 for the power source line 304, and control pad 233 for the control signal line 305.

Figure 5:
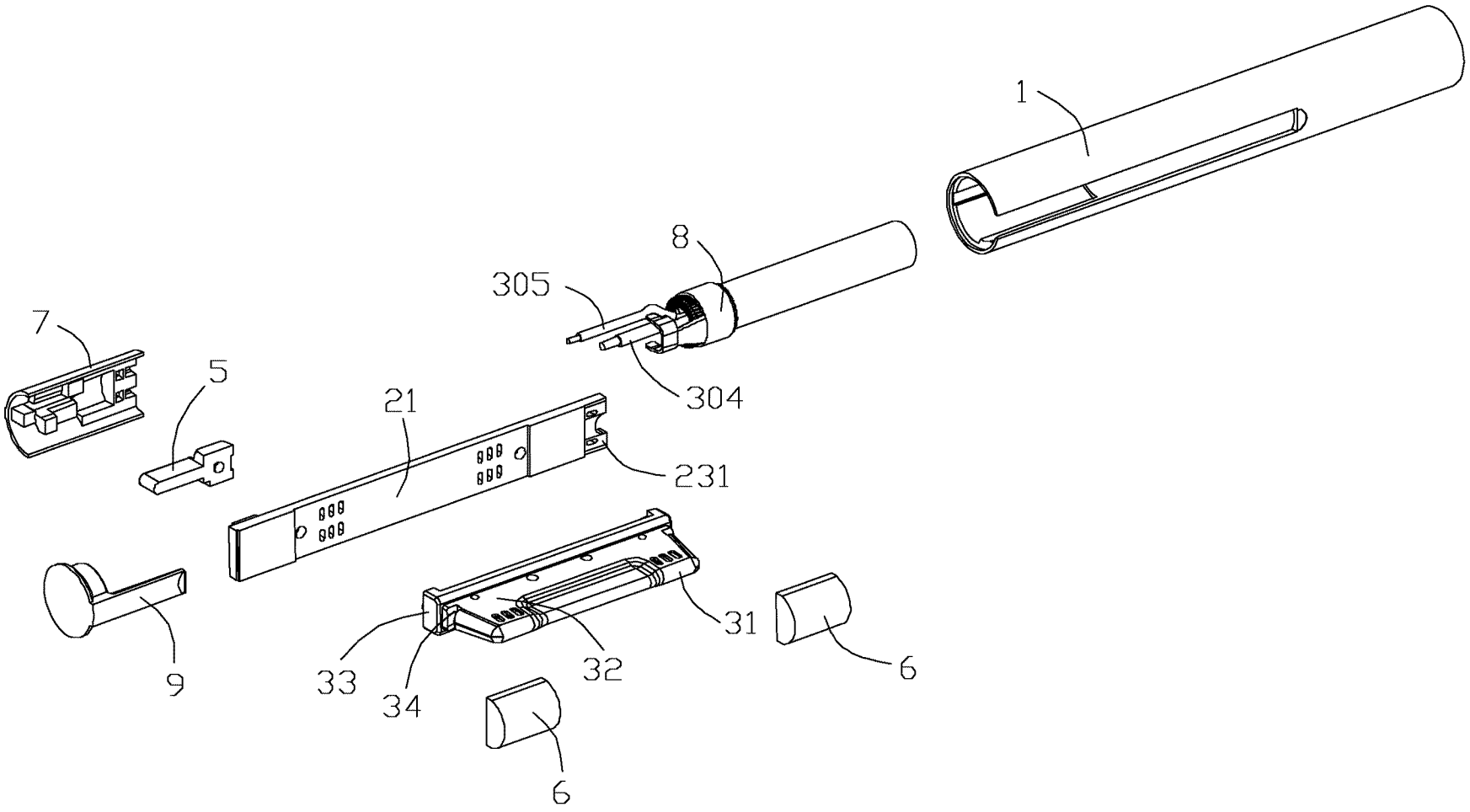
FIG. 5 a further exploded view of FIG. 2.
Figure 6:
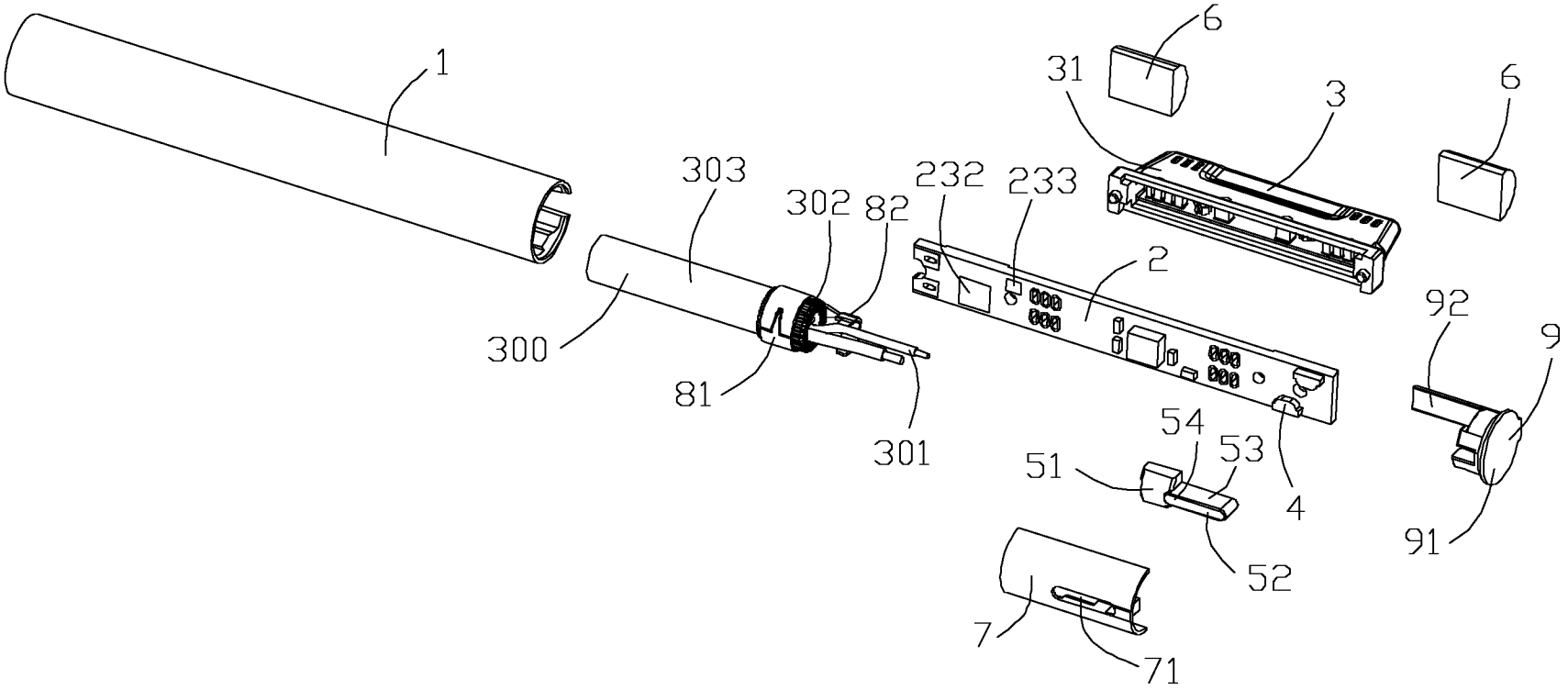
FIG. 6 is a view similar to FIG. 5 but from a different perspective.

Referring specifically to FIGS. 5 and 6, the mating member 3 comprises an insulative body 33, a plurality of terminals disposed on the insulative body 33, and a shielding 31 enclosing the insulative body 33. The mating member 3 has a mating portion 32 and holding slots 34.

The two LED lamps 4 are disposed staggeringly at two opposite sides of the light guide 5 so as to obtain light evenly coining out of the latter towards the insulative cover 1. Furthermore, the insulative cover 1 has a light region 13 of a thinned wall.

The light guide 5 has a fixing portion 51 and a light conducting portion 52. The light conducting portion 52 has two side faces 53 facing the LED lamps 4 and a top face 54 facing the light region 13. The light conducting portion 52 is generally elongate. Light from the LED lamps 4 passes through the side faces 53 and then the top face 54 to be visible at the light region 13 from outside.

The magnetic member 6 includes two pieces disposed at two sides of the mating member 3 to cooperate with corresponding magnetic member of a mating connector. The magnetic member 6 may be properly affixed to the PCB 2 by glues or the like.

The light insulator 7 is mounted on the PCB 2 and surrounds the LED lamps 4 and the light guide 5. The light insulator 7 contains stray light and protects the LED lamps 4 and the light guide 5. The light insulator 7 has a slot 71 conforming to the profile of the light conducting portion 52. Therefore, light emitting from the light guide 5 may pass through the slot 71 to the light region 13 of the insulative cover 1, eventually to be visible from outside.

The collar 8 includes a clamping portion 81 for clamping the shielding layer 302 of the cable 300 and a grounding portion 82 for soldering to the ground pad 231.

The front stopple 9 is for filling the front port 11 and filling the channel 12 by cooperating with the mating member 3. The front stopple 9 comprises a main portion 91 mating with the front port 11 of the insulative cover 1 and a protruding portion 92 extending from the main portion 91. The protruding portion 92 interference fits with the holding slot 34 to fill the channel 12 by cooperating with the mating member 3.

To assemble the plug connector assembly 100, firstly the mating member 3 and the cable 300 preassembled with the collar 8 are mounted to the PCB 2. Then, the magnetic member 6, the LED lamps 4, the light guide 5, and the light insulator 7 are mounted on the PCB 2. Next, the insulative cover 1 is mounted to the PCB 2 from the cable side until the end of the channel 12 locks into the holding slot 34 of the mating member 3. Finally, the front stopple 9 is plugged to the end of the insulative cover 1 and glues are applied to seal a seam between the front stopple 9 and the insulative cover 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector assembly comprising:

a plug connector including an insulative cover having a light region, a printed circuit board (PCB) received in the insulative cover and having a first surface and an opposite second surface, a mating member mounted on the PCB and extending through the insulative cover, a pair of light-emitting diode (LED) lamps, and a light guide disposed between the two LED lamps; and a cable connected to the PCB; wherein the mating member is mounted on the first surface of the PCB and the two LED lamps are mounted on the second surface of the PCB; the light guide has a top face exposed to the light region of the insulative cover; and the light guide comprises an elongate light conducting portion and the two LED lamps are staggeringly arranged relative to the elongate light conducting portion.

2. The plug connector assembly as recited in claim 1, further comprising a light insulator surrounding the two LED lamps and the light guide, the light insulator having a slot to expose the top face of the light guide.

3. A plug connector assembly comprising:

a cylindrical cover having one slot extending through the cylindrical cover in a radial direction and along an exterior surface in an axial direction;

a receiving space formed in said cylindrical cover;

a mating member occupying extending through said slot in said radial direction;

a slender printed circuit board positioned within the receiving space and extending along said axial direction without rotation about the axis along which the axial direction extends, said printed circuit board defining opposite first and second surfaces in said radial direction, the mating member mounted upon the first surface;

a cable including a plurality of wires mechanically and electrically connected to a rear region of the printed circuit board;

a pair of LED (Light-Emitting Diode) lamps and a light guide commonly mounted upon the second surface; wherein said pair of LED lamps are respectively located by two sides of the light guide in a transverse direction perpendicular to both said axial direction and said radial direction.

4. The plug connector assembly as claimed in claim 3, wherein said light guide includes an end exposed through the cover to an exterior.

5. The plug connector assembly as claimed in claim 4, wherein said end is exposed to the exterior in a direction opposite to said radial direction.

6. The plug connector assembly as claimed in claim 3, wherein said pair of LED lamps are offset from each other in the axial direction.

7. The plug connector assembly as claimed in claim 3, wherein said light guide is offset from the mating member in the axial direction.

8. The plug connector assembly as claimed in claim 3, wherein said wires are mechanically and electrically connected to the second surface.

9. A plug connector assembly comprising:

a cylindrical cover having one slot extending through the cylindrical cover in a radial direction and along an exterior surface in an axial direction;

a receiving space formed in said cylindrical cover;

a mating member occupying extending through said slot in said radial direction;

a slender printed circuit board positioned within the receiving space and extending along said axial direction without rotation about the axis along which the axial direction extends, said printed circuit board defining opposite first and second surfaces in said radial direction, the mating member mounted upon the first surface;

a cable including a plurality of wires mechanically and electrically connected to a rear region of the printed circuit board;

a pair of LED (Light-Emitting Diode) lamps and a light guide commonly mounted upon the second surface; wherein said pair of LED lamps are located beside the light guide in a transverse direction perpendicular to both said axial direction and said radial direction, and are offset from each other in the axial direction within a range not beyond the light guide along said axial direction.

10. The plug connector assembly as claimed in claim 9, wherein the wires are mechanically and electrically connected to the second surface.

* * * * *